US012134890B2

(12) United States Patent
Swain

(10) Patent No.: US 12,134,890 B2
(45) Date of Patent: Nov. 5, 2024

(54) WATER DRAINAGE SYSTEM

(71) Applicant: Ben Swain, Suwanee, GA (US)

(72) Inventor: Ben Swain, Suwanee, GA (US)

( * ) Notice: Subject to any disclaimer, the term of this patent is extended or adjusted under 35 U.S.C. 154(b) by 383 days.

(21) Appl. No.: 17/864,113

(22) Filed: Jul. 13, 2022

(65) Prior Publication Data

US 2024/0018774 A1 Jan. 18, 2024

(51) Int. Cl.
*E04B 1/62* (2006.01)
*E04B 1/00* (2006.01)

(52) U.S. Cl.
CPC ..... *E04B 1/62* (2013.01); *E04B 1/003* (2013.01)

(58) Field of Classification Search
CPC ..... E04B 1/62; E04B 1/003; E04B 1/0007; E03F 3/046
See application file for complete search history.

(56) References Cited

U.S. PATENT DOCUMENTS 4,663,894 A 5/1987 LaRoche et al.
5,765,328 A 6/1998 Moore
6,212,837 B1 4/2001 Davis
6,308,479 B1 * 10/2001 Prohofsky ..... E04B 9/02 52/302.1
6,393,785 B1 5/2002 Burt
6,415,571 B2 7/2002 Risser
6,688,059 B1 * 2/2004 Walker ..... E04D 13/0477 52/847
7,434,358 B2 * 10/2008 Smith ..... E04B 1/34342 52/302.1
9,187,911 B2 * 11/2015 Bowman ..... E04D 13/0477
9,353,532 B2 * 5/2016 Peterson ..... E04F 15/02183
9,353,534 B2 * 5/2016 Peterson ..... E04D 13/0477
9,644,364 B2 * 5/2017 Bowman ..... E04F 15/02183
10,590,662 B2 * 3/2020 Peterson ..... E04B 1/003
10,844,615 B2 * 11/2020 Esh, Jr. ..... E04B 1/003
10,988,943 B2 * 4/2021 Peterson ..... E04B 1/003
11,499,323 B2 * 11/2022 Peterson ..... E04F 17/00
2005/0252151 A1 11/2005 Kindred
2006/0162262 A1 * 7/2006 Smith ..... E04B 1/34342 52/58

(Continued)

OTHER PUBLICATIONS

NPL—Website available at least as early as Mar. 7, 2022 at: https://weatherdek.com/installation/.

(Continued)

*Primary Examiner* — Rodney Mintz
(74) *Attorney, Agent, or Firm* — PATENTFILE, LLC; Bradley C. Fach; Steven R. Kick

(57) ABSTRACT

A water drainage system may include a clip having a support arm, a catch arm, and a brace. The support arm may include a support arm contact surface that may be opposingly positioned to the brace. A rail may have an upper plate, a back plate, and a lower plate. The lower plate may include a plate lip that extends toward the upper plate, and a channel may be formed in the rail that extends between the upper plate, back plate, lower plate, and plate lip. The upper plate may include an upper plate contact surface that is disposed within the channel. An optional waterproof membrane may be coupled to the clip and rail by engaging the clip to the rail with a portion of the waterproof membrane tensioned between the support arm contact surface and the upper plate contact surface.

17 Claims, 5 Drawing Sheets

(56) References Cited

U.S. PATENT DOCUMENTS

| | | | | |
|---|---|---|---|---|
| 2015/0033649 | A1* | 2/2015 | Peterson | E04F 17/00 52/302.1 |
| 2015/0033650 | A1 | 2/2015 | Peterson et al. | |
| 2015/0300014 | A1 | 10/2015 | Bowman | |
| 2016/0069092 | A1* | 3/2016 | Bowman | E04F 17/00 52/705 |
| 2018/0080236 | A1* | 3/2018 | Peterson | E04B 1/003 |
| 2018/0363306 | A1* | 12/2018 | Esh, Jr. | E04F 17/00 |
| 2020/0354975 | A1* | 11/2020 | Peterson | E04F 17/00 |
| 2022/0042323 | A1* | 2/2022 | Peterson | E04F 17/00 |
| 2024/0175274 | A1* | 5/2024 | Swain | E04F 17/00 |

OTHER PUBLICATIONS

NPL—Website available at least as early as Mar. 7, 2022 at: https://duradek.com/general/45-vinyl-membrane-detail-drawings-for-decks-after-45-years.

NPL—Website available at least as early as Mar. 7, 2022 at: https://upsidebycolorguard.com/.

* cited by examiner

WATER DRAINAGE SYSTEM

FIELD OF THE INVENTION

This patent specification relates to the field of water drainage and diversion systems. More specifically, this patent specification relates to a water drainage system which may be attached below structures, such as residential and commercial decks, to direct and divert water draining through the deck.

BACKGROUND

Currently there are no reliable, cost-effective systems to create a dry space under a residential or commercial wood deck. The most common existing systems utilize plastic panels which may be purchased from a home supply store. However, these are hard to install, get clogged easily, and have to be taken down to clean. Additionally, an individual needs to be skilled to install these panels and have the tools, ladders, and other specialized tools to do the work. The other existing options are expensive and need to be installed before the deck boards are put on. Very few can be installed on an existing deck, and they cannot be easily cleaned or replaced if damaged. While some people resort to using fully finished ceilings, these are very expensive ($12-$14 sq. ft installed) and are in different product categories since these are chosen for aesthetics to give a finished ceiling look.

Therefore, a need exists for novel water drainage and diversion systems. A further need exists for novel water drainage systems which may be attached below structures, such as residential and commercial decks, to direct and divert water draining through the deck. There is also a need for novel water drainage and diversion systems which do not suffer from the above-mentioned drawbacks of existing systems.

BRIEF SUMMARY OF THE INVENTION

A water drainage system is provided which may include one or more clips that may be engaged, and more preferably removably engaged, to one or more rails so that one or more portions of a waterproof membrane may be tensioned or compressed between the clips and rails. The system may be configured to direct and divert water, such as water that may drain through a deck. Preferably, the rails may be installed with fasteners on each side of the joists that support the deck and may be angled down (preferably down one inch of slope every four feet) to where water will feed into a metal gutter or other location. Preferably, rails may be approximately four feet long and may be installed or coupled to the interior side of each deck joist and are hidden from view because they are recessed between each joist. A lightweight synthetic tear-proof and waterproof membrane may be tucked or positioned into the channels in the rails to create a "hammock" like gutter between adjacent joists. The waterproof membrane may be secured in place by clips, such as every eighteen inches. The clips hold the waterproof membrane firmly in the channel of the rails, but can be easily removed by pushing up on the clip, such as by pushing on the flange and/or support arm. Removing the clips will free the waterproof membrane to allow for easy cleaning of any debris that may accumulate over time on the waterproof membrane or to replace the waterproof membrane if damaged.

In some embodiments, a water drainage system may include a clip having a support arm, a catch arm, and a brace. The support arm and brace may be coupled to opposing ends of the catch arm, and the brace may be coupled to the support arm. The support arm may include a support arm contact surface that may be opposingly positioned to the brace. A rail may have an upper plate, a back plate, and a lower plate, and the upper plate and lower plate may be each coupled to the back plate and extend away from the back plate. The lower plate may include a plate lip that extends toward the upper plate, and a channel may be formed in the rail that extends between the upper plate, back plate, lower plate, and plate lip. The upper plate may include an upper plate contact surface that is disposed within the channel. The clip may be configured to be engaged to the rail by inserting the catch arm, the brace, and a portion of the support arm into the channel.

In further embodiments, the system may include a waterproof membrane, and the waterproof membrane may be coupled to the clip and rail by engaging the clip to the rail by inserting the catch arm, the brace, and a portion of the support arm into the channel with a portion of the waterproof membrane tensioned between the support arm contact surface and the upper plate contact surface.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
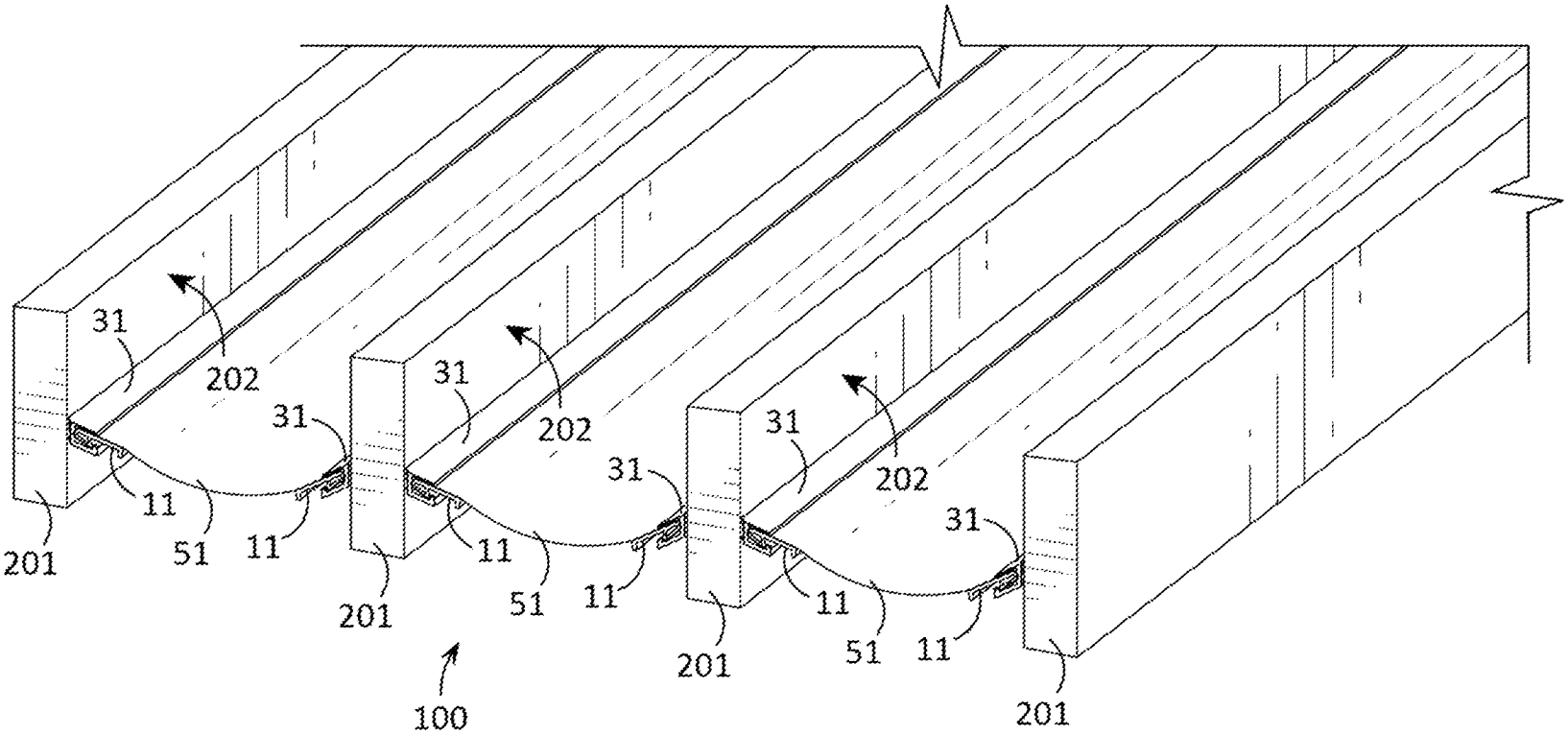
FIG. 1 depicts a top perspective view of an example of a water drainage system coupled to a plurality of joists, the system having a plurality of rails, clips, and optional waterproof membranes, according to various embodiments described herein.

For purposes of description herein, the terms "upper," "lower," "left," "right," "rear," "front," "side," "vertical," "horizontal," and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first," "second," etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, more preferably within about 5% of the actual desired value and even more preferably within about 1% of the actual desired value of any variable, element or limit set forth herein.

A new water drainage system is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

The present invention will now be described by example and through referencing the appended figures representing preferred and alternative embodiments. FIG. 1 illustrates an example of a water drainage system ("the system") 100 according to various embodiments. In some embodiments, the system 100 may comprise a plurality of clips 11 that may be engaged, and more preferably removably engaged, to a plurality of rails 31 so that one or more portions of a waterproof membrane 51 may be tensioned or compressed between the clips 11 and rails 31.

In some embodiments, the system 100 may include a clip 11 having a support arm 12, a catch arm 13, and a brace 14. The support arm 12 and brace 14 may be coupled to opposing ends of the catch arm 13, and the brace 14 may be coupled to the support arm 12. The support arm 12 may comprise a support arm contact surface 15 that may be opposingly positioned to the brace 14. The system 100 may also include a rail 31 having an upper plate 32, a back plate 33, and a lower plate 34. The upper plate 32 and lower plate 34 may each be coupled to the back plate 33 and may extend away from the back plate 33. The lower plate 34 may comprise a plate lip 35 that extends toward the upper plate 32. A channel 36 may be formed that extends between the upper plate 32, back plate 33, lower plate 34, and plate lip 35, and the upper plate 32 may comprise an upper plate contact surface 37 that is disposed within the channel 36. The clip 11 may be configured to be engaged to the rail 31 by inserting the catch arm 13, the brace 14, and a portion of the support arm 12 into the channel 36.

In further embodiments, the system 100 may include a waterproof membrane 51, and the waterproof membrane 51 may be coupled to a clip 11 and a rail 31 by engaging the clip 11 to the rail 31 by inserting the catch arm 13, the brace 14, and a portion of the support arm 12 into the channel 36 with a portion of the waterproof membrane 51 tensioned between the support arm contact surface 15 and the upper plate contact surface 37.

The system 100 may comprise one or more waterproof membranes 51. Generally, a waterproof membrane 51 may comprise a generally flexible material that may be waterproof. In preferred embodiments, a waterproof membrane 51 may be made from or may comprise polymer sheeting, such as Polypropylene (PP), Medium Density Polyethylene (MDPE), Linear Low-Density Polyethylene (LLDPE), Low Density Polyethylene (LDPE), High Density Polyethylene (HDPE), any other polyethylene, Polyvinyl chloride, or any other flexible polymer material that may be waterproof.

Figure 2:
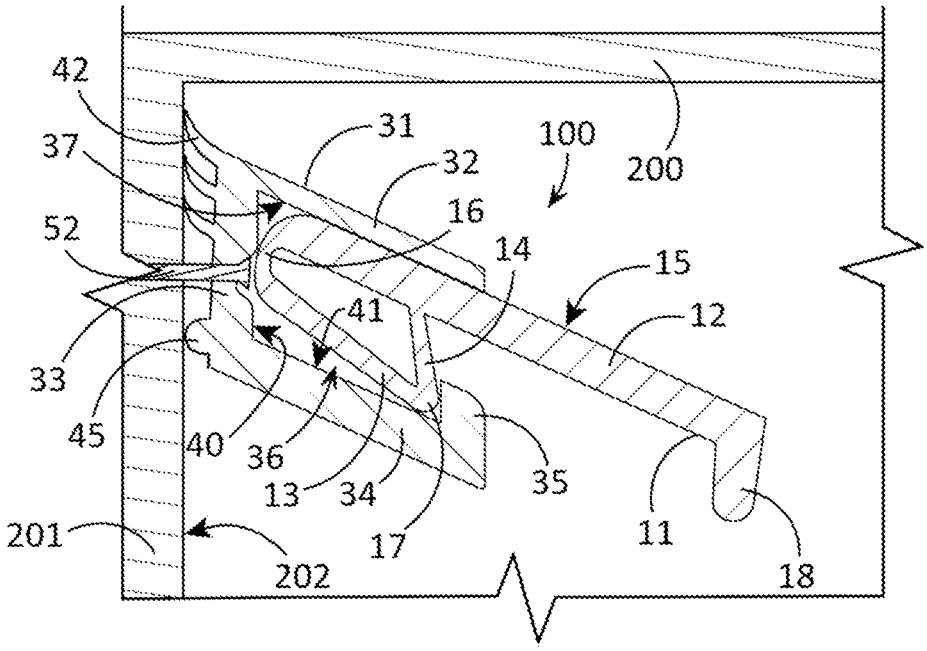
FIG. 2 illustrates a sectional, elevation view of an example of a rail coupled to a joist and a clip engaged to the rail according to various embodiments described herein.

Preferably, a waterproof membrane 51 may be elongated in length and may be coupled between two objects, such as between two joists 201 of a deck 200, as shown in FIGS. 1 and 2, via a plurality of clips 11 and rails 31. The rails 31 may be coupled to two joists 201 of a deck 200 via a plurality of fasteners 52 and portions of two sides of the length of a waterproof membrane 51 may be coupled to the one or more rails 31 that are coupled to the two joists 201 via positioning portions of the two sides of the length of a waterproof membrane 51 in the channels 36 of the rails 31 and then engaging a plurality of clips 11 to the rails 31 with the portions of the two sides of the waterproof membrane 51 tensioned or compressed in the channels 36 by the clips 31.

The system 100 may include one or more clips 11. In some embodiments, a clip 11 may comprise a support arm 12, a catch arm 13, and a brace 14. The support arm 12 and brace 14 may be coupled to opposing ends of the catch arm 13, and the brace 14 may be coupled to the support arm 12. The support arm 12 may comprise a support arm contact surface 15 that may be opposingly positioned to the brace 14. A clip 11 may be configured in any size and shape. Preferably, a clip 11 may have a length that is less than the length of a rail 31 (with the length dimension of the rail 31 being the largest dimension of the rail 31). For example, a clip 11 may have a length that is approximately 10 percent of the length of a rail 31 so that two or more, such as a plurality of, clips 11 may be coupled to a rail 31.

Preferably, a support arm 12, a catch arm 13, and a brace 14 may be coupled together in a generally triangular arrangement with the support arm 12 forming one side of the triangular arrangement that may be at least as long as, but preferably longer than, the catch arm 13 and/or brace 14. A support arm 12 may comprise a support arm contact surface 15 that may be opposingly positioned to the brace 14 so that the brace 14 and support arm contact surface 15 may be positioned on opposing sides of the support arm 12.

The upper plate 32, back plate 33, and lower plate 34, may comprise one or more contact surfaces which may be configured to contact portions of a clip 11 when a clip 11 is engaged to a rail 31 and which may contact portions of a waterproof membrane 51 that may be positioned between a clip 11 and rail 31 when the clip 11 is engaged to the tail 31. For example, an upper plate 32 may comprise one or more upper plate contact surfaces 37, a back plate 33 may comprise one or more back plate contact surfaces 40, and a lower plate 34 may comprise one or more lower plate contact surfaces 41.

Figure 3:
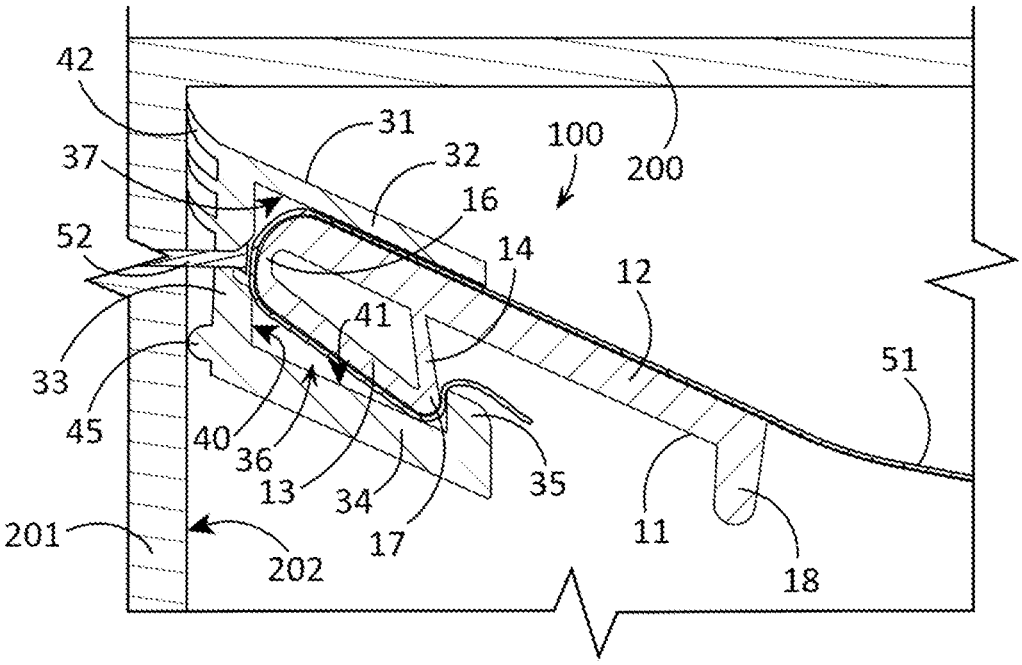
FIG. 3 shows a sectional, elevation view of an example of a rail coupled to a joist and a clip engaged to the rail with a portion of a waterproof membrane tensioned between the clip and rail according to various embodiments described herein.
Figure 4:
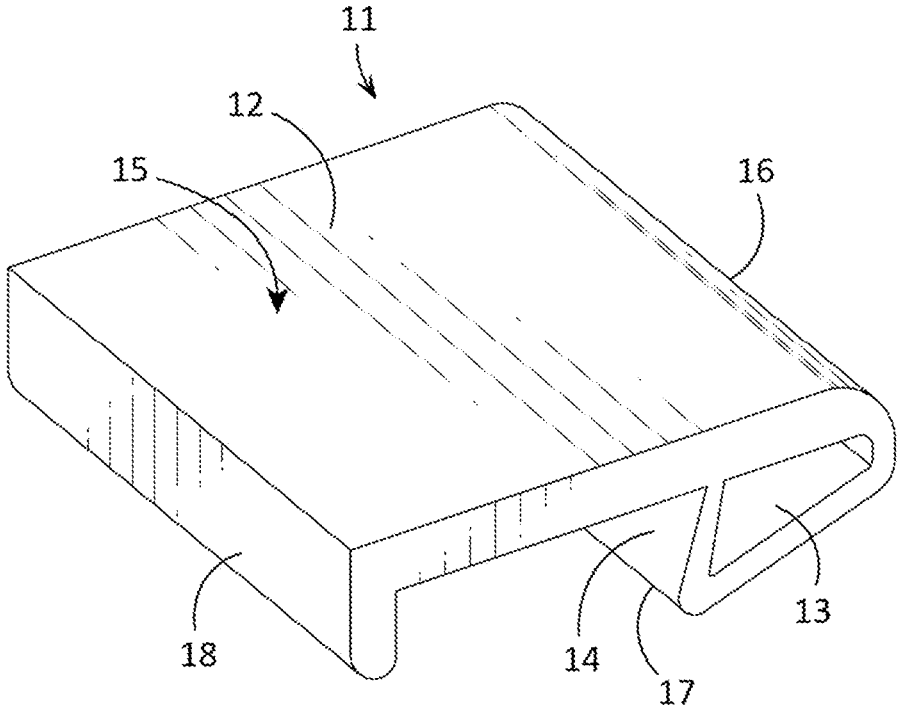
FIG. 4 depicts a top perspective view of an example of a clip according to various embodiments described herein.
Figure 5:
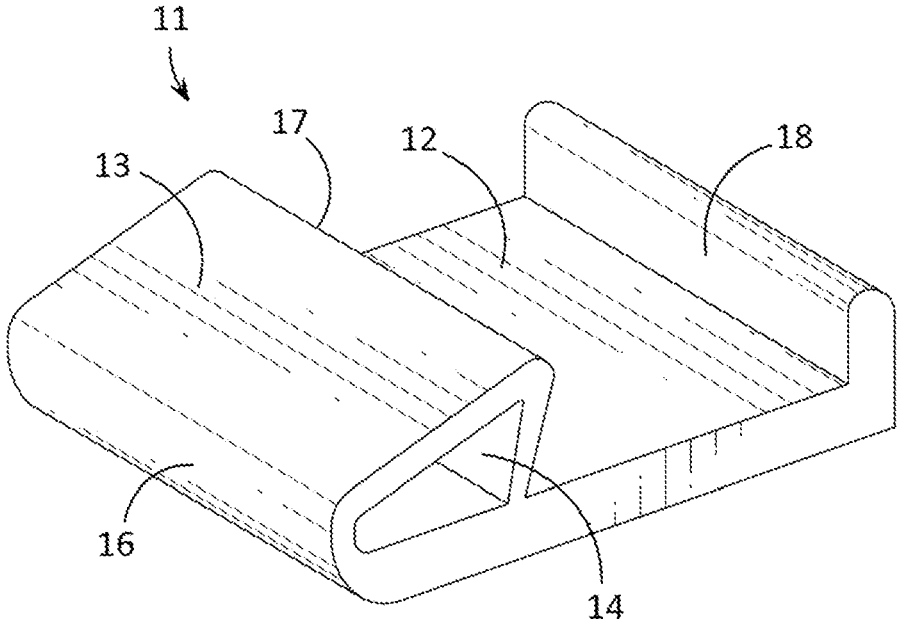
FIG. 5 illustrates a bottom perspective view of an example of a clip according to various embodiments described herein.
Figure 6:
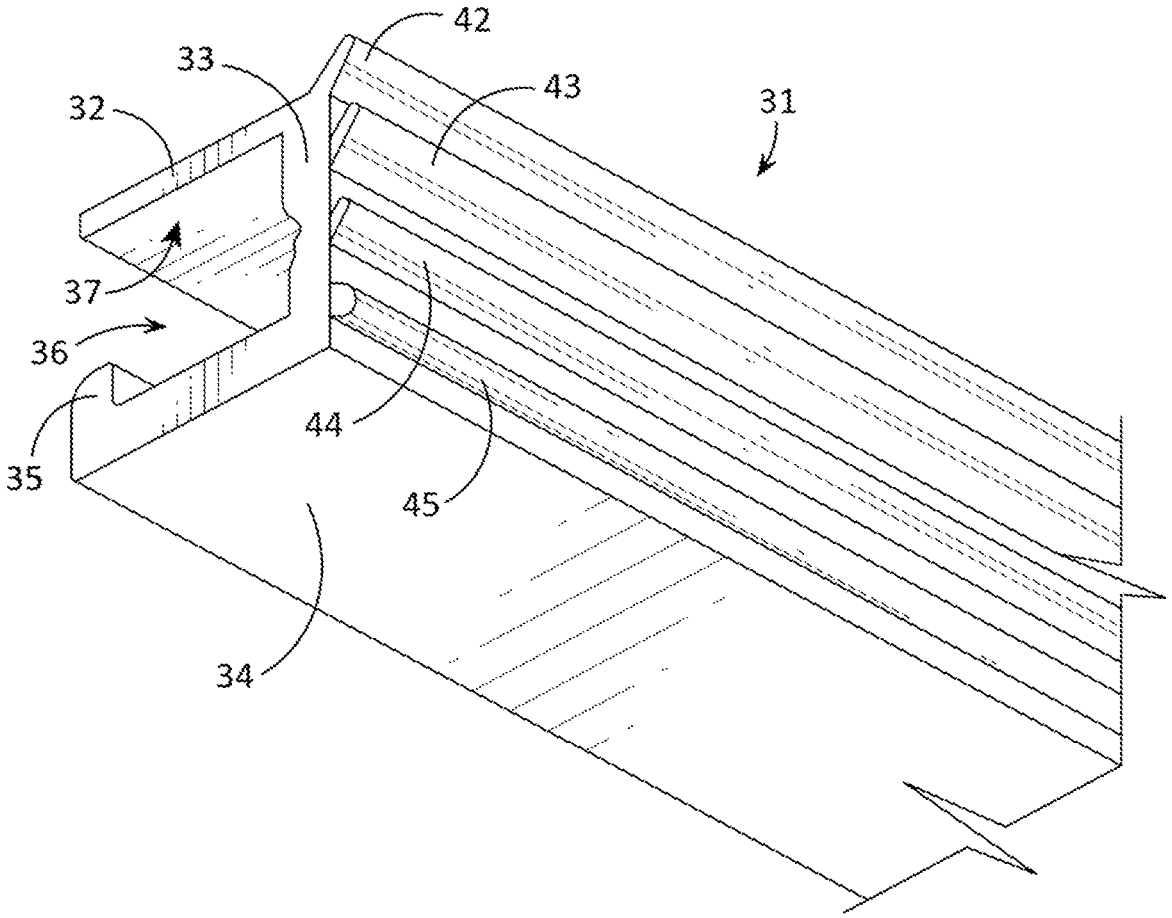
FIG. 6 shows a bottom perspective view of an example of a rail according to various embodiments described herein.
Figure 7:
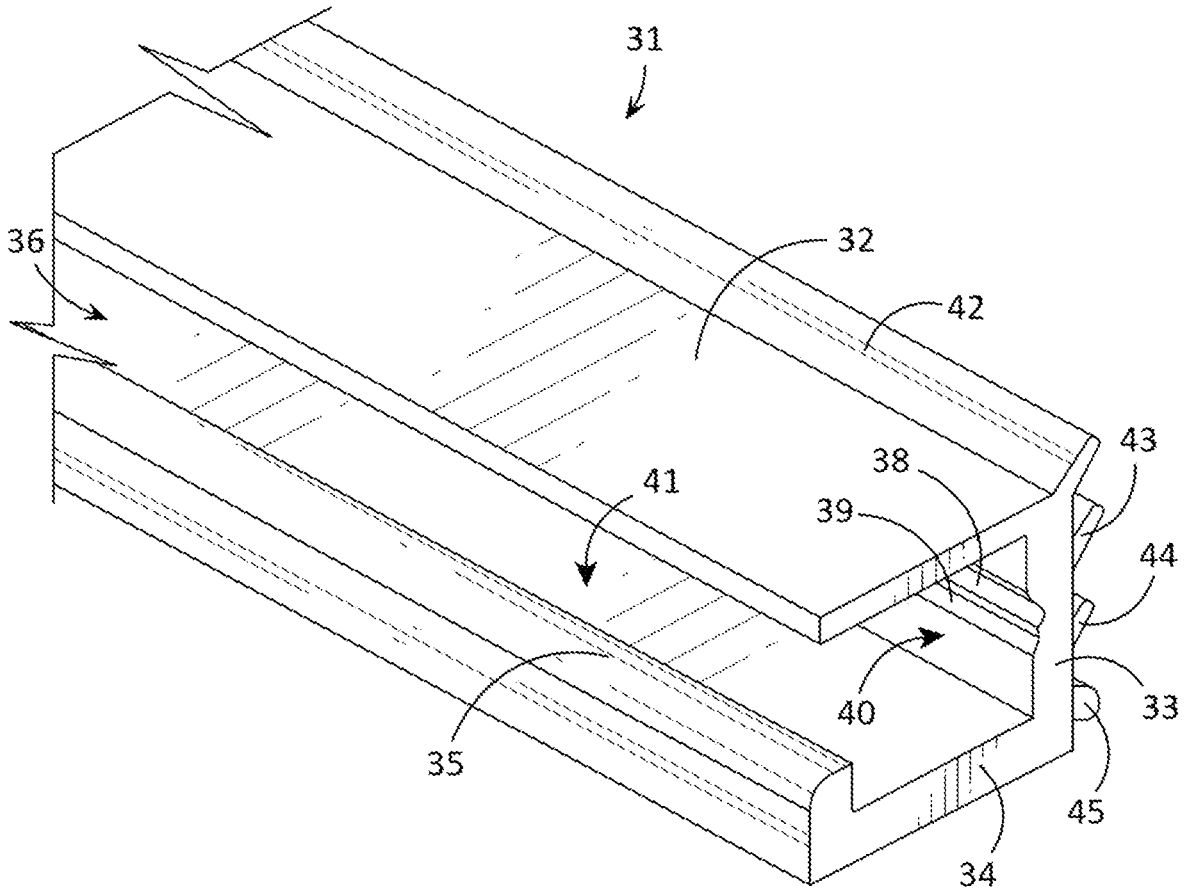
FIG. 7 depicts a top perspective view of an example of a rail according to various embodiments described herein.

In some embodiments, when the clip 11 is engaged to a rail 31, the support arm contact surface 15 and an upper plate contact surface 37 may contact each other as shown in FIG. 2. In further embodiments, a portion of a waterproof membrane 51 may be positioned within a channel 36 of a rail 31 and may be tensioned between the support arm contact surface 15 of a clip 11 and the upper plate contact surface 37 of the rail 31 when the clip 11 is engaged to the rail 31 as shown in FIG. 3. A support arm contact surface 15 and an upper plate contact surface 37 may be configured in any shape and size. Preferably, a support arm contact surface 15 and an upper plate contact surface 37 may comprise a generally flat or planar shape, although a support arm contact surface 15 and an upper plate contact surface 37 may be configured in any shape which may be suitable for contacting and tensioning a portion of a waterproof membrane 51 between the two surfaces 15, 37, without tearing or puncturing the waterproof membrane 51.

In some embodiments, a clip 11 may comprise a support arm 12 and catch arm 13 that may be coupled together via a distal junction 16, and the distal junction 16 is configured to contact a back plate contact surface 40 of the back plate 33 of a rail 31 when the clip 11 is engaged to the rail 31 as shown in FIG. 2. In further embodiments, a portion of a waterproof membrane 51 may be positioned within a channel 36 of a rail 31 and may be tensioned between the distal junction 16 and a back plate contact surface 40 the back plate 33 of the rail 31 when the clip 11 is engaged to the rail 31 as shown in FIG. 3. Preferably, a distal junction 16 may be rounded in shape, although a distal junction 16 may be configured in any shape which may be suitable for contacting and tensioning a portion of a waterproof membrane 51 to a back plate 33 without tearing or puncturing the waterproof membrane 51.

In some embodiments, a clip 11 may comprise a catch arm 13 and brace 14 that may be coupled together via a medial junction 17, and the medial junction 17 is configured to contact the plate lip 35 and/or a lower plate contact surface 41 of the lower plate 34 of a rail 31 when the clip 11 is engaged to the rail 31 as shown in FIG. 2. In further embodiments, a portion of a waterproof membrane 51 may be positioned within a channel 36 of a rail 31 and may be tensioned between the distal junction 16 and the plate lip 35 and/or a lower plate contact surface 41 of the lower plate 34 of the rail 31 when the clip 11 is engaged to the rail 31 as shown in FIG. 3. Preferably, a medial junction 17 may be rounded in shape, although a medial junction 17 may be configured in any shape which may be suitable for contacting and tensioning a portion of a waterproof membrane 51 to a plate lip 35 and/or a lower plate 34 without tearing or puncturing the waterproof membrane 51.

In some embodiments, a clip 11 may comprise a flange 18 that may be coupled to its support arm 12. A flange 18 may be configured in any size and shape. Generally, a flange 18 may form a projection that extends away from the support arm 12. In some embodiments, a flange 18 may be positioned so that the flange 18 and distal junction 16 are on opposing ends of the support arm 12. In further embodiments, a flange 18 may to any location on a support arm 12.

The system 100 may include one or more rails 31, and each rail may have an upper plate 32, a back plate 33, and a lower plate 34. The upper plate 32 and lower plate 34 may each be coupled to the back plate 33 and may extend away from the back plate 33. The lower plate 34 may comprise a plate lip 35 that extends toward the upper plate 32. A channel 36 may be formed that extends between the upper plate 32, back plate 33, lower plate 34, and plate lip 35, and the upper plate 32 may comprise an upper plate contact surface 37 that is disposed within the channel 36.

In preferred embodiments, a rail 31 may comprise a resilient material which may enable one or more elements of the rail 11 to bend and flex or otherwise be moved relative to another element of the rail 31. In further preferred embodiments, a rail 31 may comprise a resilient material, such as by all or portions of an upper plate 32, a back plate 33, a lower plate 34, and/or a plate lip 35 being made from a resilient material, so that the upper plate 32 may be configured to flex towards and away from the plate lip 35 and/or lower plate 34. In further embodiments, a rail 31 may comprise a resilient material, and the plate lip 35 and/or lower plate 34 may be configured to flex towards and away from the upper plate 32. Generally, a resilient material of the rail 31 may provide enough flex to enable portions of a clip 11 to be inserted and engage to the rail 31 with and without portions of a waterproof membrane 51 positioned between the clip 11 and rail 31.

Generally, a resilient material may be flexible to allow slight deformation and resilient so as to return to its original shape after deformation. Example resilient materials may include: natural rubber materials, such as latex rubber, forms of the organic compound isoprene, such as polyisoprene, and the like; synthetic rubber materials, such as Polyacrylate Rubber, Ethylene-acrylate Rubber, Polyester Urethane, Bromo Isobutylene Isoprene, Polybutadiene, Chloro Isobutylene Isoprene, Polychloroprene, Chlorosulphonated Polyethylene, Epichlorohydrin, Ethylene Propylene, Ethylene Propylene Diene Monomer, Polyether Urethane, Perfluorocarbon Rubber, Fluoronated Hydrocarbon, Fluoro Silicone, Fluorocarbon Rubber, Hydrogenated Nitrile Butadiene, Polyisoprene, Isobutylene Isoprene Butyl, Acrylonitrile Butadiene, Polyurethane, Styrene Butadiene, Styrene Ethylene Butylene Styrene Copolymer, Polysiloxane, Vinyl Methyl Silicone, Acrylonitrile Butadiene Carboxy Monomer, Styrene Butadiene Carboxy Monomer, Thermoplastic Polyether-ester, Styrene Butadiene Block Copolymer, Styrene Butadiene Carboxy Block Copolymer, and the like; a flexible polymer, such as polytetrafluoroethylene (PTFE), polyethylene terephthalate (PET), high-density polyethylene (HDPE), polyvinyl chloride (PVC), polypropylene (PP), Polystyrene (PS), Polycarbonate (PC), low density polyethylene (LDPE), Polyoxymethylene (POM), Acrylonitrile butadiene styrene (ABS), Polyethylene/Acrylonitrile Butadiene Styrene (PE/ABS), Polycarbonate/Acrylonitrile Butadiene Styrene (PC/ABS), Ultra High Molecular Weight polyethylene, Polyurethanes (PU), Polyamides (PA); or any other suitable flexible natural or synthetic material including combinations of materials, which is flexible to allow slight deformation and resilient so as to return to its original shape after deformation.

An upper plate 32, a back plate 33, a lower plate 34, and a plate lip 35 may be configured in any shape and size. In some embodiments, an upper plate 32, a back plate 33, a lower plate 34 may be coupled together to form an elongated C-shape which may preferably extend the entire length of the rail 31. Optionally, an upper plate 32 and a lower plate 34 may extend away from the back plate 33 in approximately the same direction and in an approximately parallel (plus or minus ten degrees) configuration. Optionally, a rail 31 may comprise a single lower plate 34 which may extend approximately the entire length of the rail 31, or a rail 31 may comprise two or more lower plates 34 which may each extend only a portion of the entire length of the rail 31. Optionally, a rail 31 may comprise a single plate lip 35 which may extend approximately the entire length of the rail 31, or a rail 31 may comprise two or more plate lips 35 which may each extend only a portion of the entire length of the rail 31.

In some embodiments, a back plate 33 may comprise one or more recesses, such as a first recess 38, and a second recess 39. In preferred embodiments, a back plate 33 may comprise one or more recesses 38, 39, that may be positioned within the channel 36 and which may be depressed below or form an aperture in the one or more back plate contact surfaces 40 of the back plate 33. Recesses 38, 39, may be configured in any shape and size, and may be configured to enable or facilitate attaching a rail 31 to an object, such as a deck joist 201 and or which may facilitate engaging a clip 11 to a rail 31 by enabling the distal junction 16 to have extra room during engagement positioning. In some embodiments, a recess 38, 39, may comprise an aperture or hole in the back plate 33 suitable for receiving a fastener 52, such as a screw, bolt, rivet, etc., which may be used to secure the rail 31 to objects such as deck joists 201. For example, a rail 31 may comprise a plurality of recesses 38, 39, configured as fastener 52 apertures. In some embodiments, a recess 38, 39, may comprise a depression of a finite length, e.g., a circular or oval depression, in the back plate 33 suitable for facilitating engagement of a clip 11 to a rail 31 and/or for receiving a fastener 52, such as a screw, bolt, rivet, etc., which may be used to secure the rail 31 to objects, such as deck joists 201. For example, a rail 31 may comprise a plurality of recesses 38, 39, configured as distal junction 16 receiving depressions/fastener 52 depressions. In some embodiments, a recess 38, 39, may comprise a depression which may extend approximately the entirety of the length of the back plate 33 suitable for facilitating engagement of a clip 11 to a rail 31 and/or for receiving a fastener 52, such as a screw, bolt, rivet, etc., which may be used to secure the rail 31 to objects, such as deck joists 201. For example, a rail 31 may comprise a first recess 38 and a second recess 39 which may extend approximately the entirety of the length of the back plate 33 and which may be configured as distal junction 16 receiving depressions/fastener 52 depressions.

In some embodiments, a rail 31 may comprise one or more fins, such as a first fin 42, a second fin 43, and a third fin 44, which may be coupled to the back plate 33 and/or to the upper plate 32. In preferred embodiments, one or more fins 42, 43, 44, may extend the entire length of the back plate 33 and/or the entire length of the rail 31. Generally, a fin 42, 43, 44, may comprise a projection of material which may extend away from the back plate 33 and/or upper plate 32. In some embodiments, a rail 31 may comprise a first fin 42 that may be coupled to the junction of the upper plate 32 and back plate 33. In further embodiments, a rail 31 may comprise one or more fins 43, 44, that may be coupled to the back plate 33 between the junction of the back plate 33 and upper plate 32 and between the junction of the back plate 33 ad lower plate 34. Preferably, a first fin 42 that is positioned closest to the junction of the upper plate 32 and back plate 33 may be larger than the one or more other fins 43, 44, that may be coupled below it.

In some embodiments, a fin 42, 43, 44, may be made from a generally rigid material, such as hard plastic, metal, fiberglass, etc., so that all or a portion of the fin 42, 43, 44, may embed in an object that the rail 31 may be coupled to so that the fin 42, 43, 44, may prevent water from passing between the back plate 33 and object that the rail 31 may be coupled to. In preferred embodiments, a fin 42, 43, 44, may comprise a resilient material, so that the fin 42, 43, 44, may be a flexible fin 42, 43, 44, which may enable the fin 42, 43, 44, to flex/slightly deform and press against an object that the rail 31 may be coupled to so that the fin 42, 43, 44, may prevent water from passing between the back plate 33 and object that the rail 31 may be coupled to.

In some embodiments, a rail 31 may comprise one or more pivot protrusions 45 which may be coupled to the back plate 33 so that the pivot protrusions 45 are opposingly positioned to the back plate contact surface 40. In preferred embodiments, a pivot protrusion 45 may extend the entire length of the back plate 33 and/or the entire length of the rail 31. Generally, a pivot protrusion 45 may comprise a projection of material which may extend away from the back plate 33. Preferably, a pivot protrusion 45 may be configured to not deform or to deform to a lesser extent than one or more fins 42, 43, 44, that may also be coupled to a back plate 33. A pivot protrusion 45 may be positioned anywhere on a rail 31. Preferably, a pivot protrusion 45 may be positioned closer to the lower plate 34 than to the upper plate 32.

Generally, a pivot protrusion 45 may be configured to contact an object that a rail 31 is coupled to and pitch the junction of the upper plate 32 and back plate 33, along with any fins 42, 43, 44, coupled to the backplate 33, towards the object that the rail 31 is coupled to via a fastener 52 when the fastener 52 is tightened to compress the junction of the upper plate 32 and back plate 33 and/or to compress any fins 42, 43, 44, coupled to the backplate 33 firmly against the wood joist. In preferred embodiments, a rail 31 may comprise at least one fin 42, 43, 44, and pivot protrusion 45 which prevent the back plate 33 from contacting a surface that the rail 31 is coupled to, such as by preventing the back plate 33 from contacting a joist surface 202 of a joist 201 that the rail 31 is coupled to.

The system 100 of the present invention may be configured to direct and divert water, such as water that may drain through a deck 200. The rails 31 may be installed with screw type fasteners 52 on each side of the wood joists 201 that support the deck 200 and may be angled down (preferably down one inch of slope every four feet) to where water will feed into a metal gutter or other location. Preferably, rails 31 may be approximately four feet long and may be installed or coupled to the interior side of each deck joist 201 and are hidden from view because they are recessed between each joist 201. A lightweight synthetic tear-proof and waterproof membrane 51 may be tucked into the channel 36 in the rails 31 to create a "hammock" like gutter between adjacent joists 201. The waterproof membrane 51 may be secured in place by clips 11, such as every eighteen inches. The clips 11 hold the waterproof membrane 51 firmly in the channel 36 of the rails 31, but can be easily removed by pushing up on the clip 11, such as by pushing on the flange 18 and/or support arm 12. Removing the clips 11 will free the waterproof membrane 51 to allow for easy cleaning of any debris that may accumulate over time on the waterproof membrane 51 or to replace the waterproof membrane 51 if damaged.

Preferably, clips 11 include a distal junction 16 configured as a rounded edge to easily slip into the rail channels 36 and snap in securely to hold the waterproof membrane 51 in place. The medial junction 17 of the clip 11 catches on the preferably, squared plate lip 35 of the rail 31 so the clip 11 cannot be pulled straight out. To release the clip 11 from the channel 36, it can be pushed up and it will release it from the plate lip 35 of the rail 31. Preferably, the upper plate 32 of the rail 31 may be thinner, so as to be more flexible, than the lower plate 34 which allows the upper plate 32 to flex and release the clip 11. The clip 11 also may have a rounded flange 18 on the backside to allow for a good grip when installing and removing the clip 11.

Preferably, a rail 31 may have a series of flexible fins 42, 43, 44, that may seal out water that may attempt to run down between the joist 201 and rail 31. The fins 42, 43, 44, may be made of relatively pliable PVC and the rest of the rail is made of relatively harder PVC material. Preferably, a rail 31 may have a pivot protrusion 45 below the fins 42, 43, 44, that may pitch the rail 31 forward when a fastener 52 is tightened to compress the fins 42, 43, 44, firmly against an object, such as a wood joist 201. The rail 31 preferably angles down to feed water in the waterproof membrane 51 where the water runs down toward the lower end and empties into a standard metal gutter or other device or location.

While some exemplary shapes and sizes have been provided for elements of the system 100, it should be understood to one of ordinary skill in the art that the clip 11, rail 31, optional waterproof membrane 51, and any other element described herein may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

Additionally, while some materials have been provided, in other embodiments, the elements that comprise the system 100 may be made from or may comprise durable materials such as aluminum, steel, other metals and metal alloys, wood, hard rubbers, hard plastics, fiber reinforced plastics, carbon fiber, fiberglass, resins, polymers or any other suitable materials including combinations of materials. Additionally, one or more elements may be made from or may comprise durable and slightly flexible materials such as soft plastics, silicone, soft rubbers, or any other suitable materials including combinations of materials. In some embodiments, one or more of the elements that comprise the system 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the system 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the system 100 may be coupled by being one of connected to and integrally formed with another element of the system 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A water drainage system configured to be positioned below a deck, the system comprising:

a clip having a support arm, a catch arm, and a brace, wherein the support arm and brace are coupled to opposing ends of the catch arm, wherein the brace is coupled to the support arm, and wherein the support arm comprises a support arm contact surface that is opposingly positioned to the brace, wherein the catch arm and the brace are coupled together via a medial junction; and a rail having an upper plate, a back plate, and a lower plate, wherein the upper plate and lower plate are each coupled to the back plate and extend away from the back plate, wherein the lower plate comprises a plate lip that extends toward the upper plate, wherein a channel is defined in the rail that extends between the upper plate, back plate, lower plate, and plate lip, and wherein the upper plate comprises an upper plate contact surface that is disposed within the channel; and wherein the clip is engaged inside the rail such that the catch arm, the brace, and a portion of the support arm are positioned in the channel, the upper plate contact surface and the support arm contact surface directly contact each other and the medial junction contacts the plate lip.

2. The system of claim 1, wherein the back plate comprises a recess that is positioned within the channel.

3. The system of claim 1, wherein the rail comprises a fin that is coupled to the back plate.

4. The system of claim 1, wherein the support arm and catch arm are coupled together via a distal junction, and wherein the distal junction is configured to contact the back plate when the clip is engaged to the rail.

5. The system of claim 4, wherein the clip comprises a flange that is coupled to the support arm and positioned so that the flange and distal junction are on opposing ends of the support arm.

6. The system of claim 1, wherein the rail comprises a pivot protrusion that extends away from the back plate, and wherein the pivot protrusion is positioned closer to the lower plate than to the upper plate.

7. The system of claim 6, wherein the rail comprises a resilient fin that is coupled to the back plate and which extends away from the back plate and upper plate.

8. The system of claim 7, wherein the resilient fin and pivot protrusion prevent the back plate from contacting a surface that the rail is coupled to.

9. A water drainage system configured to be positioned below a deck, the system comprising:

a clip having a support arm, a catch arm and a brace, wherein the support arm and brace are coupled to opposing ends of the catch arm, wherein the brace is coupled to the support arm, and wherein the support arm comprises a support arm contact surface that is opposingly positioned to the brace, wherein the catch arm and the brace are coupled together via a medial junction;

a rail having an upper plate, a back plate, and a lower plate, wherein the upper plate and lower plate are each coupled to the back plate and extend away from the back plate, wherein the lower plate comprises a plate lip that extends toward the upper plate, wherein a channel is defined in the rail that extends between the upper plate, back plate, lower plate, and plate lip, and wherein the upper plate comprises an upper plate contact surface that is disposed within the channel; and a waterproof membrane, wherein the waterproof membrane is coupled to the clip and the rail by engagement of the clip inside the rail such that the catch arm, the brace, and a portion of the support arm are positioned in the channel with an upper portion of the waterproof membrane tensioned between the support arm contact surface and the upper plate contact surface and a lower portion of the waterproof membrane tensioned between the medial junction and the plate lip.

10. The system of claim 9, wherein the back plate comprises a recess that is positioned within the channel.

11. The system of claim 9, wherein the rail comprises a fin that is coupled to the back plate.

12. The system of claim 9, wherein the rail comprises a resilient material, and wherein the upper plate is configured to flex towards and away from the plate lip.

13. The system of claim 9, wherein the support arm and catch arm are coupled together via a distal junction, and wherein the waterproof membrane tensioned between the distal junction and the back plate when the clip is engaged to the rail.

14. The system of claim 13, wherein the clip comprises a flange that is coupled to the support arm and positioned so that the flange and distal junction are on opposing ends of the support arm.

15. The system of claim 9, wherein the rail comprises a pivot protrusion that extends away from the back plate, and wherein the pivot protrusion is positioned closer to the lower plate than to the upper plate.

16. The system of claim 15, wherein the rail comprises a resilient fin that is coupled to the back plate and which extends away from the back plate and upper plate.

17. The system of claim 16, wherein the resilient fin and pivot protrusion prevent the back plate from contacting a surface that the rail is coupled to.

* * * * *